US005680431A

United States Patent [19]

Pietras, III et al.

[11] Patent Number: 5,680,431

[45] Date of Patent: Oct. 21, 1997

[54] X-RAY GENERATOR

[75] Inventors: Joseph Steven Pietras, III, Hamilton Square, N.J.; Kenneth Stephenson, Newnham Cambridge, England

[73] Assignee: Schlumberger Technology Corporation, Ridgefield, Conn.

[21] Appl. No.: 630,736

[22] Filed: Apr. 10, 1996

[51] Int. Cl.[6] ..... H01J 35/00

[52] U.S. Cl. ..... 378/119; 378/121; 378/137

[58] Field of Search ..... 378/119, 121, 378/122, 136, 137, 138

[56] References Cited

U.S. PATENT DOCUMENTS

| | | | |
|---|---|---|---|
| 4,490,609 | 12/1984 | Chevalier | 250/269 |
| 5,191,517 | 3/1993 | Stephenson | 363/59 |
| 5,428,658 | 6/1995 | Oettinger et al. | 378/121 |
| 5,442,678 | 8/1995 | Dinsmore et al. | 378/121 |

OTHER PUBLICATIONS

Pietras, J.S. and Smith, S.R., "Photomultiplier Tubes and Detector Packaging for Hostile Environments", *IEEE Transactions on Nuclear Science*, vol. 35, No. 1, (Feb. 1988).

*Primary Examiner*—Don Wong

*Attorney, Agent, or Firm*—Leonard W. Pojunas; Brigitte L. Jeffrey; Keith G. W. Smith

[57] ABSTRACT

An x-ray generator including a light source; a high temperature photocathode arranged so as to be illuminated by light from the light source; an accelerator for accelerating electrons emitted by the photocathode; and a target onto which accelerated electrons impinge so as to produce x-rays, the target being held at substantially ground potential. The accelerator is arranged so that the photocathode is at a low voltage end of a voltage multiplier, typically held at about −100 kV, and the target is at the high voltage end at ground potential. The voltage multiplier can include a bank of nested tubular capacitor members which surround the photocathode and accelerator section and are arranged such that the outer surface is at ground potential, the same as the target.

21 Claims, 2 Drawing Sheets

X-RAY GENERATOR

FIELD OF THE INVENTION

The present invention relates to an x-ray generator, and in particular to an x-ray generator suitable for use in a borehole logging tool.

BACKGROUND OF THE INVENTION

X-ray generators have been previously proposed for use in borehole logging tools. One such proposal has been to use a 100 kV x-ray generator to produce bremstraalung photons from a tungsten target for use in measuring the density and Pe of a fluid in the borehole. In one such x-ray generator, electrons are produced at a grounded source (for example a thermionic cathode with a power consumption of 2 W) and accelerated along an acceleration tube to a target which is held at elevated potential (positive high voltage) with respect to the cathode. In view of the high voltage present at the target, the x-ray source is physically surrounded by high-voltage (HV) insulation such that the outer part of the generator is at or near ground potential and the high voltage target is surrounded by the insulation. The HV insulation degrades over time due to the intense x-ray flux (the target, and hence the source of x-rays, is located within the insulator which is typically a sleeve surrounding a diode arrangement) and this degradation is hastened by the high temperatures typically encountered in use by a borehole logging tool. Degradation of the HV insulator can ultimately result in failure of the source and possible tool damage due to exposure to high voltages.

U.S. Pat. No. 5,191,517 (incorporated herein by reference) discloses a particle accelerator in which a voltage multiplier comprises a bank of nested tubular capacitors which are progressively shorter in length towards the innermost part of the bank. The high voltage end of the multiplier is the innermost capacitor such that the high voltage part is surrounded by insulation and the outside potential is at or near ground. With a conventional x-ray generator arrangement, it would be necessary to place the target within the capacitor bank in this type of structure and the problems with HV insulation degradation would ensue.

X-ray tubes using a photoemissive cathode at a high negative voltage with respect to a grounded target are known. To date, however, these have proved unsuitable for borehole use due to the problem of irreversible degradation of the photocathode in use at the temperatures encountered in borehole use, often as high as 175° C.

Photocathodes based on $Na_2KSb$ material have been proposed for high temperature photomultiplier uses (see, for example, Photomultiplier Tubes and Detector Packaging for Hostile Environments, J. S. Pietras and S. R. Smith, IEEE Transactions on Nuclear Science, Vol. 35, No. 1, February 1988). Such materials have not heretofore found use as a photocathode in an x-ray generator and the performance of such materials in PMT applications is significantly different from the requirements of an x-ray generator because the currents, and consequently the effects of the resistance of the cathode, are dramatically higher, typically by a factor of $10^6$.

It is an object of the present invention to provide an x-ray source which is suitable for borehole use and does not suffer from the problems associated with HV insulation degradation mentioned above.

SUMMARY OF THE INVENTION

According to one aspect of the present invention, there is provided an x-ray generator, comprising a light source; a high temperature photocathode, such as a $Na_2KSb$ photocathode, arranged so as to be illuminated by light from the light source; an accelerator for accelerating electrons emitted by the photocathode; and a target onto which accelerated electrons impinge so as to produce x-rays, the target being held at substantially ground potential.

The advantage of this arrangement is that by maintaining the target at ground potential, it is not necessary for it to be surrounded by HV insulation, those parts of the structure which do require such insulation being well away from the region of high x-ray flux. The use of a high temperature photocathode ensures continued performance at borehole temperatures and means that it is not necessary to have to supply electrical power to the cathode and enables the cathode to be held at a very high negative voltage with respect to the target. This provides the voltage difference needed to accelerate the electrons to sufficient energy to generate the x-rays.

The light source is typically a blue LED and is arranged to illuminate the photocathode, preferably a high temperature photocathode, via a fiber optic light guide.

The accelerator is arranged so that the photocathode is at the negative voltage end of a voltage multiplier, typically held at about −100 kV, and the target is at ground potential. The voltage multiplier can include a bank of nested tubular capacitor members which surround the photocathode and accelerator section and are arranged such that the outer surface is at ground potential, the same as the target.

The target is preferably outside the capacitor bank and x-ray shielding can be disposed between the target and the accelerator so as to reduce x-ray degradation of high voltage insulation. Another advantage of this arrangement is the the target, and hence the source of x-rays can be positioned close to the borehole wall and to detectors which is desirable for formation evaluation measurements.

DESCRIPTION OF THE PREFERRED EMBODIMENT

Figure 1:
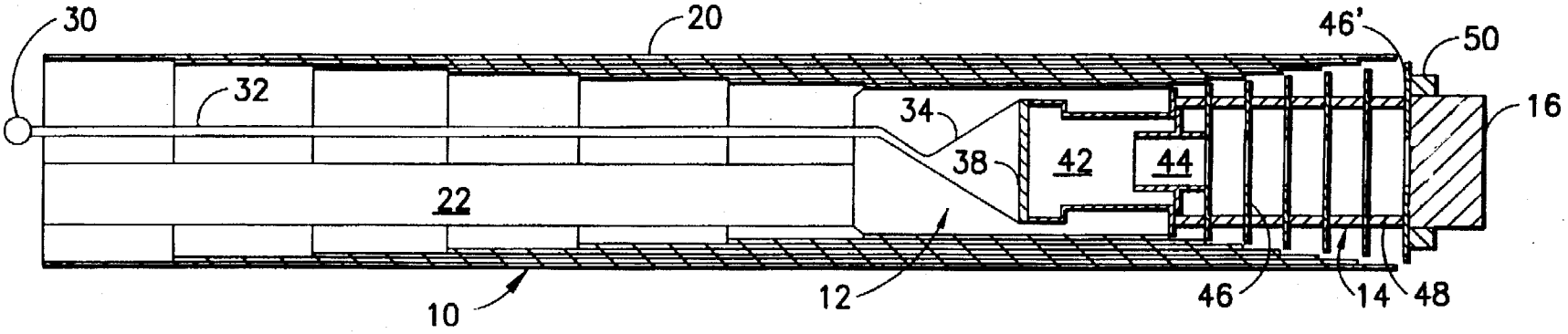
FIG. 1 shows a schematic view of an x-ray generator according to the invention.

Referring now to FIG. 1, the x-ray generator shown therein broadly comprises a voltage multiplier section 10, a cathode section 12, an acceleration tube 14 and a target 16.

The voltage multiplier section 10 comprises a bank of nested tubular d.c. capacitors 20 and an a.c. capacitor string 22. The d.c. bank 20 is formed from tubular foils separated by high voltage insulation in substantially the same manner as is described in U.S. Pat. No. 5,191,517. Each foil is connected to a corresponding stage of the a.c. bank which is provided with an a.c. input of 8.5 kV peak-to-peak by means of a transformer (see FIG. 3). This arrangement provides a compact voltage multiplier suitable for use in borehole tools in which the fields vary in a linear manner in the axial and radial directions. The voltage multiplier is configured such the innermost stage is held at −102 kV and the outermost surface is at or near ground potential.

The cathode section 12 comprises a blue LED light source 30, such as a GaN LED (450 nm) made by Nichia Industries, which is located outside the voltage multiplier section 10.

Figure 2:
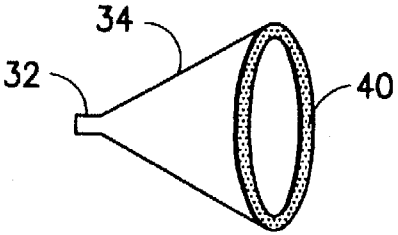
FIG. 2 shows an end view of the light spreader used in the embodiment of FIG. 1.

The LED 30 is connected to a fiber optic bundle light guide 32 which passes through the d.c. capacitor bank 20 to a light spreader 34 and photocathode 38 located within the innermost stage. The photocathode 38 comprises a circular sapphire plate having a coating of doped $Na_2KSb$ material. Examples of dopants are Li, As, Te, or Sn. Other materials might be used, for example undoped $Na_2KSb$, provided that they provide sufficient current without unduly high resistance and have sufficient stability at elevated temperatures. At the wavelength of the source (450 nm), this material typically has a quantum efficiency of 15–20% and can provide currents in excess of 20 μA for extended periods of time. At the light spreader 34, the individual fibers in the bundle 32 are spread out to form a ring as is shown in more detail in FIG. 2. This ring or circular array of fiber ends 40 contacts the peripheral region Of the photocathode 38.

Electrons are emitted by the photocathode 38 into the focusing section 42 of the acceleration tube 14 which comprises an extraction tube 44 and a series of rings 46 mounted on an insulating carrier 48, each of which is connected to a respective foil of the d.c. capacitor bank 20 so as to provide a progressive increase in voltage away from the photocathode 38. The final ring 46' carries a tungsten target 16 which is surrounded by high-Z shielding material 50 to reduce x-ray flux back into the voltage multiplier 10 and so reduce degradation of the HV insulation. This ring and the target 16 is not connected electrically to the voltage multiplier 10 and is at ground potential. The target can be mounted on an elongate extension if required.

While electrons are accelerated from the cathode 38 towards the target 16, gas which is in the acceleration tube 14 can become ionized and result in a stream of positive ions which are accelerated towards the cathode 38. This ion current passes along the center of the acceleration tube 14 and the ions strike the photocathode 38 at a central region thereof. After some time, this can lead to a dead spot being formed in the cathode such that no electrons would be emitted when it is illuminated. This problem is avoided by the use of the light spreader 34 which uses the peripheral region of the photocathode 38 away from the central region to emit electrons which are then focused into the acceleration tube 14. This region is substantially unaffected by the positive ion current and so should provide constant output.

Figure 3:
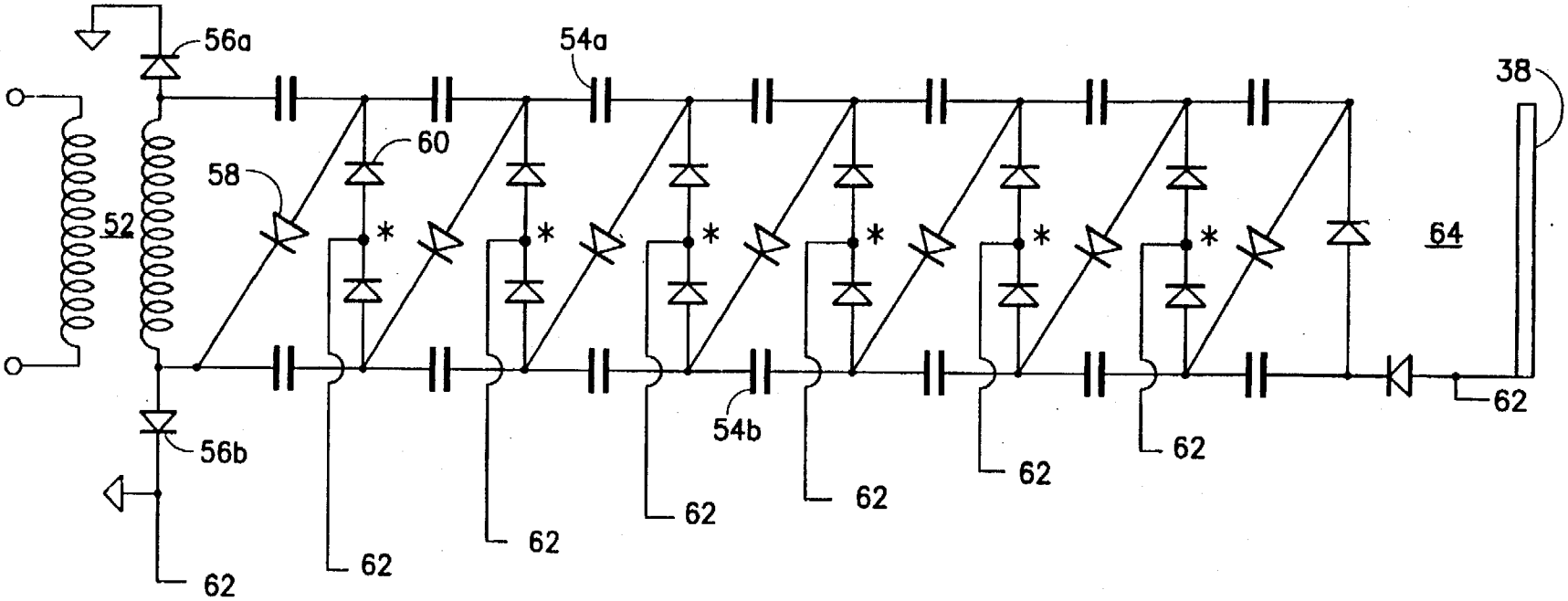
FIG. 3 shows a schematic view of the voltage multiplier used in the embodiment of FIG. 1.

FIG. 3 shows the electronic arrangement of the voltage multiplier 10 and acceleration tube 14. An a.c. supply is connected to one side of a transformer 52. The other side of the transformer is connected across two banks of capacitors **54*a*, 54*b* and also through two diodes 56*a*, 56*b* to ground. The arrangement of the diodes 56*a*, 56*b* is such that, when the current is flowing in one direction, one end of the transformer is at ground potential and the other is at elevated potential. When the current flow is reversed, the previously grounded end is elevated and the previously elevated end is grounded but since the direction of current flow is reversed, the effect is such that the difference between the ends is twice the difference between any end and ground. This reduces the current required to obtain the potential difference and hence the power required. The two banks of capacitors 54*a*, 54*b* are cross connected through diodes 58, 60. The diode connection 60** comprises a pair of diodes in series which provide a neutral point * in-between the diodes of the pair which has no a.c. component and is used as the connection point to the foils 62 forming the d.c. capacitor bank 20. The final stage 64 also connects to the photocathode 38.

The system described above using two banks of a.c. capacitors is not the only manner of constructing an a.c. capacitor bank for use in this invention. For example, a single bank of a.c. capacitors, or a bank of a.c. capacitors and a bank of d.c. capacitors may be used instead of the a.c. capacitor bank 22.

X-ray generators according to the invention find particular application in the field of borehole logging tools in view of their compact size, temperature stability and low power consumption.

We claim:

1. An x-ray generator, comprising:

a) a light source;

b) a $Na_2KSb$ photocathode arranged so as to be illuminated by light from the light source;

c) an accelerator for accelerating electrons emitted by the photocathode; and d) a target onto which accelerated electrons impinge so as to produce x-rays, the target being held at substantially ground potential.

2. An x-ray generator as claimed in claim 1, wherein the light source comprises an LED and a light guide leading from the LED to the photocathode.

3. An x-ray generator as claimed in claim 2, wherein the LED emits blue light.

4. An x-ray generator as claimed in claim 2, wherein the light guide comprises an optical fiber.

5. An x-ray generator as claimed in claim 1, wherein the $Na_2KSb$ photocathode comprises a doped $Na_2KSb$ material.

6. An x-ray generator as claimed in claim 5, wherein a dopant comprises one of Li, As Te and Sn.

7. An x-ray generator as claimed in claim 1, wherein the accelerator creates a positive ion beam which impinges on a central part of the photocathode, the generator further comprising a light spreader which illuminates the photocathode away from the central part, and a focusing section which focuses electron emitted by the photocathode into the accelerator.

8. An x-ray generator as claimed in claim 7, wherein the photocathode comprises a plate and the light speader directs light from the source onto a peripheral region of the plate.

9. An x-ray generator as claimed in claim 1, further comprising a voltage multiplier which comprises a bank of radially arranged capacitors, the photocathode and a high negative voltage end of the accelerator being located within the bank of capacitors.

10. An x-ray generator as claimed in claim 9, wherein the bank of capacitors comprises a series of tubular members having progressively smaller axial lengths, the tubular member which is innermost having the smallest axial length.

11. An x-ray generator as claimed in claim 9, wherein the capacitor which is outermost is held at substantially ground potential.

12. An x-ray generator as claimed in claim 9, wherein the capacitor which is innermost is at the same potential as the high negative voltage end of the accelerator.

13. An x-ray generator as claimed in claim 9, wherein the target is positioned outside the bank of capacitors.

14. An x-ray generator as claimed in claim 13, wherein high voltage insulation is positioned between the capacitors around the accelerator and shielding is placed between the target and the capacitors so as to prevent degradation of the insulation by x-ray flux.

15. An x-ray generator, comprising:

a voltage multiplier;

a light source; and an x-ray tube comprising a high temperature photocathode arranged so as to be illuminated by light from the light source, a grounded target electrically isolated from the voltage multiplier, and an accelerator electrically connected to the voltage multiplier and located between the photocathode and the target whereby electrons emitted by the photocathode are accelerated towards the target and cause x-rays to be generated when striking the target.

16. An x-ray generator as claimed in claim 15, wherein the light source further comprises a fiber optic bundle light guide and a light spreader by which the light source illuminates the photocathode.

17. An x-ray generator as claimed in claim 16, further comprising means for focusing electrons emitted by the photocathode into the accelerator.

18. An x-ray generator as claimed in claim 15, wherein the high temperature photocathode comprises a $Na_2KSB$ material.

19. An x-ray generator as claimed in claim 15, wherein the voltage multiplier comprises a bank of concentric tubular capacitor members, the photocathode being located inside the bank of capacitor members.

20. An x-ray generator as claimed in claim 19, wherein the light source and target are located outside the bank of capacitor members.

21. An x-ray generator as claimed in claim 19, wherein the capacitor member which is outermost is at substantially ground potential.

* * * * *